US005515142A

United States Patent [19]

Rommelmann

[11] Patent Number: 5,515,142

[45] Date of Patent: May 7, 1996

[54] DONOR ROLLS WITH SPIRAL ELECTRODES FOR COMMUTATION

[75] Inventor: Heiko Rommelmann, Webster, N.Y.

[73] Assignee: Xerox Corporation, Stamford, Conn.

[21] Appl. No.: 339,614

[22] Filed: Nov. 15, 1994

[51] Int. Cl.[6] ..... G03G 15/06

[52] U.S. Cl. ..... 355/259; 355/245; 355/261

[58] Field of Search ..... 355/245, 247, 355/249, 259, 261, 262, 265; 118/653, 654

[56] References Cited

U.S. PATENT DOCUMENTS

| | | | |
|---|---|---|---|
| 3,980,541 | 9/1976 | Aine | 204/186 |
| 3,996,892 | 12/1976 | Parker et al. | 118/658 |
| 4,868,600 | 9/1989 | Hays et al. | 355/259 |
| 5,172,170 | 12/1992 | Hays | 355/259 |
| 5,268,259 | 12/1993 | Sypula | 430/311 |
| 5,289,240 | 2/1994 | Wayman | 355/259 |
| 5,339,142 | 8/1994 | Hays | 355/259 |
| 5,360,940 | 11/1994 | Hays | 118/654 |
| 5,386,277 | 1/1995 | Hays et al. | 355/259 |
| 5,394,225 | 2/1995 | Prker | 355/259 |
| 5,422,709 | 6/1995 | Minagawa et al. | 355/247 |

*Primary Examiner*—Sandra L. Brase
*Attorney, Agent, or Firm*—John W. Wagley

[57] ABSTRACT

A donor roll for transporting marking particles to an electrostatic latent image recorded on a surface is provided. The donor roll includes a body rotatable about a longitudinal axis and an electrode member. The electrode member includes a plurality of electrical conductors mounted on the body with adjacent electrical conductors being spaced from one another having at least a portion thereof extending in a direction transverse to the longitudinal axis of the body.

31 Claims, 5 Drawing Sheets

DONOR ROLLS WITH SPIRAL ELECTRODES FOR COMMUTATION

The present invention relates to a developer apparatus for electrophotographic printing. More specifically, the invention relates to a donor roll as part of a scavengeless development process.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent to the electrostatic latent image on a photoreceptor, the electrostatic charge on the photoreceptor will cause the toner particles to be pulled off the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll. In the development zone adjacent to the electrostatic latent image on a photoreceptor, the electrostatic charge on the photoreceptor will cause the toner particles to be attracted from the developer roll to the photoreceptor.

An important variation to the general principle of development is the concept of "scavengeless" development. The purpose and function of scavengeless development are described more fully in, for example, U.S. Pat. No. 4,868,600 to Hays et al., which is hereby incorporated by reference. In a scavengeless development system, toner is detached from the donor roll by applying an AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image on image" color xerography.

A typical "hybrid" scavengeless development apparatus includes, within a developer housing, a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. The donor roll advances toner from the loading zone to the development zone adjacent the photoreceptor. In the development zone, i.e., the nip between the donor roll and the photoreceptor, are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud forming a toner powder image thereon.

Another variation on scavengeless development uses a single-component developer material. In a single component scavengeless development, the donor roll and the electrode structure create a toner powder cloud in the same manner as the above-described scavengeless development, but instead of using carrier and toner, only toner is used.

It has been found that for some toner materials, the tensioned electrically biased wires in self-spaced contact with the donor roll tend to vibrate which causes non-uniform solid area development. Furthermore, there is a possibility that debris can momentarily lodge on the wire to cause streaking. Thus, it would appear to be advantageous to replace the externally located electrode wires with electrodes integral to the donor roll.

In U.S. Pat. No. 5,172,170 to Hays et al., there is disclosed an apparatus for developing a latent image recorded on a surface, including a housing defining a chamber storing at least a supply of toner therein; a moving donor member spaced from the surface and adapted to transport toner from the chamber of the housing to a development zone adjacent the surface, and an electrode member integral with the donor member and adapted to move therewith. The electrode member is electrically biased to detach toner from the donor member to form a cloud of toner in the space between the electrode member and the surface with toner developing the latent image. The biasing of the electrodes is typically accomplished by using a conductive brush which is placed in a stationary position in contact with the electrodes on the periphery of the donor member. U.S. Pat. No. 5,172,170 is herein incorporated by reference. The conductive brush is electrically connected with a electrically biasing source. Typically only the electrode in the nip between the donor member and the developing surface is electrically biased. As the donor member rotates the electrode that now is in the nip needs to contact the brush. Since the distance between the nip and the developing surface is very small it is impractical to position the conductive brush in the nip. To accomplish the biasing of the donor member, the member must be extended beyond the developing surface. The donor member is typically an expensive complicated component that is very long and slender.

Since the donor member must be very accurately positioned relative to the developing surface, the donor member must be very accurately manufactured with extremely tight cylindricity requirements. Manufacturing methods limit the cylindricity that may be obtained. Further, the roll must be rigid enough that the donor member does not sag when in use. To extend the donor member past the developing surface sufficiently to position the conductive brush beyond the developing surface further increases its length, making it even more difficult to obtain the required cylindricity. The added length increases its cost, weakens its rigidity, and makes it more difficult to manufacture the member.

The following disclosures related to scavangeless and electroded rolls may be relevant to various aspects of the present invention:

U.S. Pat. No. 5,289,240 Patentee: Wayman Issue Date: Feb. 22, 1994

U.S. Pat. No. 5,268,259 Patentee: Sypula Issue Date: Dec. 7, 1993

U.S. Pat. No. 5,172,170 Patentee: Hays et al. Issue Date: Dec. 15, 1992

U.S. Pat. No. 4,868,600 Patentee: Hays et al. Issue Date: Sep. 19, 1989

U.S. Pat. No. 3,996,892 Patentee: Parker et al. Issue Date: Dec. 14, 1976

U.S. Pat. No. 3,980,541 Patentee: Aine Issue Date: Sep. 14, 1976

U.S. Pat. No. 5,289,240 discloses a donor roll which has two distinct set of electrodes along the periphery of the donor roll. The roll has a first set of electrodes that extend axially the length of the roll, are interconnected to each other and contact the filaments of a brush. The roll also has a second set of electrodes that extend axially the length of the roll, are interconnected to each other and do not contact the brush.

U.S. Pat. No. 5,268,259 discloses a process for preparing a toner donor roll which has an integral electrode pattern. The process includes coating a cylindrical insulating member with a photoresistive surface, pattern exposing the photoresistive surface to light to form an electrode pattern and depositing conductive metal on the portion of the member exposed to light to form the electrode pattern.

U.S. Pat. No. 5,172,170 discloses a donor roll with a plurality of electrical conductors spaced from one another with one of the conductors located in one of the grooves in the donor roll. A dielectric layer is disposed in at least the grooves of the roll interposed between the roll and the conductors and may cover the region between the grooves. The dielectric layer may be fabricated of anodized aluminum or a polymer and may be applied by spraying, dipping or powder spraying. The roll is made from a conductive material such as aluminum and the dielectric layer is disposed about the circumferential surface of the roll between adjacent grooves. The conductive material is applied to the grooves by a coater to form the electrical conductors. A charge relaxable layer is applied over the donor roll surface.

U.S. Pat. No. 4,868,600 discloses a scavengeless development system in which toner detachment from a donor and the concomitant generation of a controlled powder cloud is obtained by AC electrical fields supplied by self-spaced electrode structures positioned within the development nip. The electrode structure is placed in close proximity to the toned donor within the gap between toned donor and image receiver, self-spacing being effected via the toner on the donor.

U.S. Pat. No. 3,996,892 discloses a donor roll having an electrically insulative core made of a phenloic resin. The donor roll core is coated with conductive rubber doped with carbon black. Conductor strips are formed on the rubber by a copper cladding process followed by a photo-resist-type etching technique.

U.S. Pat. No. 3,980,541 discloses composite electrode structures including mutually opposed electrodes spaced apart to define a fluid treatment region. Resistive electrodes serve to localize the effects of electrical shorts between electrodes. Non-uniform sheet and filamentary electrodes are disclosed for producing a substantially non uniform electric field.

SUMMARY OF THE INVENTION

According to the present invention, there is provided a donor roll for transporting marking particles to an electrostatic latent image recorded on a surface. The donor roll includes a body rotatable about a longitudinal axis and an electrode member. The electrode member includes a plurality of electrical conductors mounted on the body with adjacent electrical conductors being spaced from one another having at least a portion thereof extending in a direction transverse to the longitudinal axis of the body.

According to the present invention, there is also provided a developer unit for developing a latent image recorded on an image receiving member to form a developed image. The developer unit includes a housing defining a chamber for storing at least a supply of toner therein and a moving donor member. The member is spaced from the surface and adapted to transport toner from the chamber of the housing to a development zone adjacent the surface. The donor member includes a body rotatable about a longitudinal axis and an electrode member. The electrode member includes a plurality of electrical conductors mounted on the body with adjacent electrical conductors being spaced from one another having at least a portion thereof extending in a direction transverse to the longitudinal axis of the body.

According to the present invention, there is further provided an electrophotographic printing machine of the type having a developer unit adapted to develop with marking particles an electrostatic latent image recorded on a photoconductive member. The machine includes a housing defining a chamber for storing at least a supply of toner therein and a moving donor member. The member is spaced from the surface and adapted to transport toner from the chamber of the housing to a development zone adjacent the surface. The donor member includes a body rotatable about a longitudinal axis and an electrode member. The electrode member includes a plurality of electrical conductors mounted on the body with adjacent electrical conductors being spaced from one another having at least a portion thereof extending in a direction transverse to the longitudinal axis of the body.

IN THE DRAWINGS

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 3:
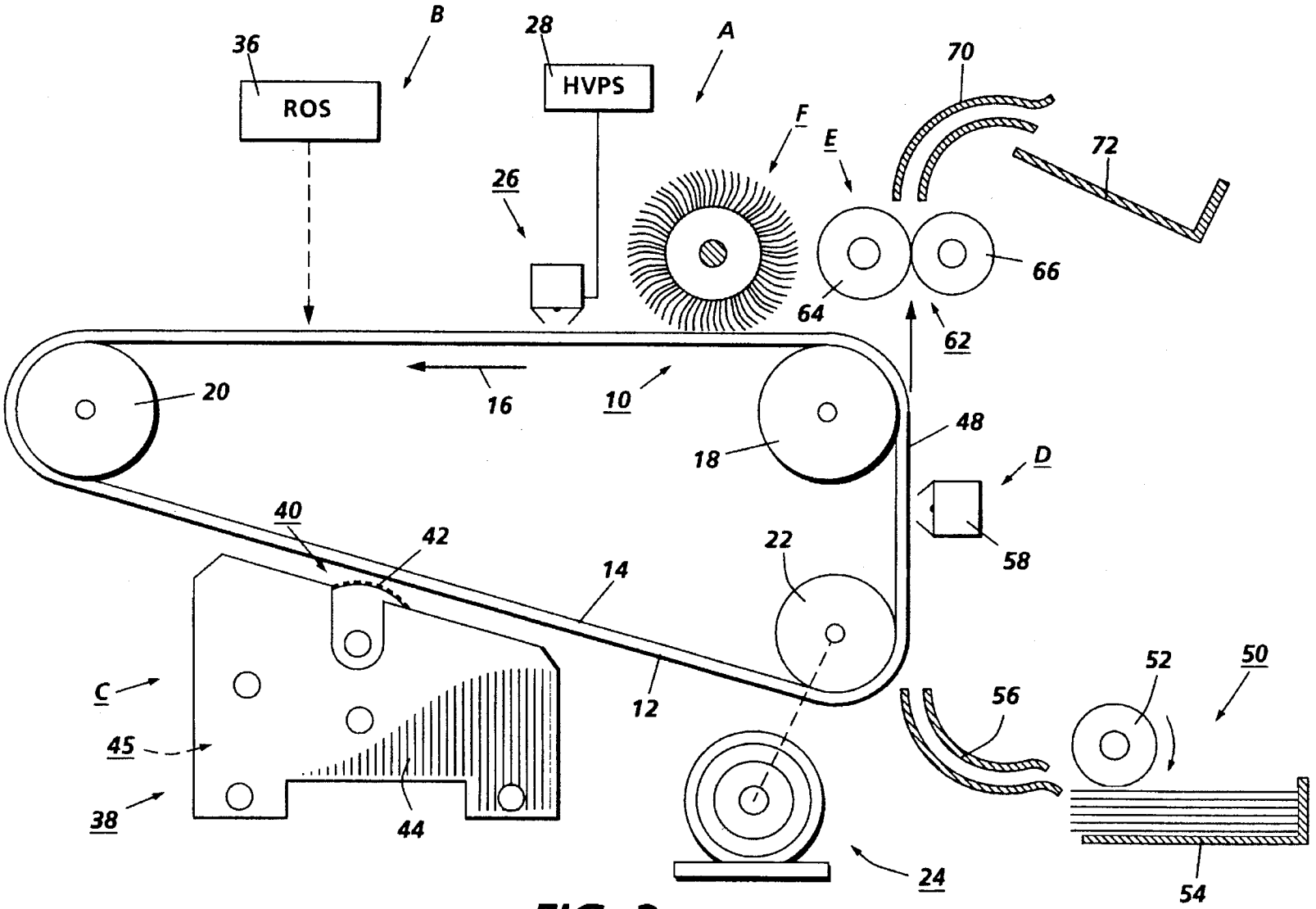
FIG. 3 is a schematic elevational view of development unit incorporating the spiral segmented donor roll for use in the printing machine of FIG. 1.

Referring initially to FIG. 3, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26.

Next, the charged portion of photoconductive surface 12 is advanced through exposure station B. At exposure station B, ROS 36 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 3. At development station C, a development system 38, develops the latent image recorded on the photoconductive surface. Preferably, development system 38 includes a donor roll or roller 40 and electrode wires 42 positioned in the gap between the donor roll 40 and photoconductive belt 10. Electrodes 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in the chamber of developer housing 44. The chamber in developer housing 44 stores a supply of developer material 45. The developer material is a two component developer material of at least magnetic carrier granules having toner particles adhering triboelectrically thereto. A transport roll or roller 46 disposed interiorly of the chamber of housing 44 conveys the developer material to the donor roll 40. The transport roll 46 is electrically biased relative to the donor roll 40 so that the toner particles are attracted from the transport roller to the donor roller.

Again referring to FIG. 3, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Referring again to FIG. 3, there is shown development system 38 in greater detail. Housing 44 defines the chamber for storing the supply of developer material 45 therein. The developer material 45 includes carrier granules 76 having toner particles 78 adhering triboelectrically thereto. Positioned in the bottom of housing 44 is are horizontal augers 80 and 82 which distributes developer material 45 uniformly along the length of transport roll 46 in the chamber of housing 44.

Transport roll 46 comprises a stationary multi-pole magnet 84 having a closely spaced sleeve 86 of non-magnetic material, preferably aluminum, designed to be rotated about the magnet 84 in a direction indicated by arrow 85. Because the developer material 45 includes magnetic carrier granules 76, the effect of the sleeve 86 rotating through stationary magnetic fields is to cause developer material 45 to be attracted to the exterior of the sleeve 86. A doctor blade 88 meters the quantity of developer adhering to sleeve 86 as it rotates to a loading zone 90, the nip between transport roll 46 and donor roll 40.

The donor roll 40 is kept at a specific voltage, by a direct current, DC voltage source 92 to attract a layer of toner particles 78 from transport roll 46 to donor roll 40 in the loading zone 90.

An alternating current, AC, voltage source 93 may also be connected to the donor roll 40. The effect of the AC electrical field applied along the donor roller in loading zone or nip 90 is to loosen the toner particles 78 from their adhesive and triboelectric bonds to the carrier particles 76. Either the whole of the donor roll 40, or at least a peripheral layer thereof, is preferably of material which has low electrical conductivity. The material must be sufficiently conductive to prevent any build-up of electric charge with time, and yet its conductivity must be sufficiently low to form a blocking layer to prevent shorting or arcing of the magnetic brush to the donor roller.

Transport roll 46 is biased by both a DC voltage source 94 and an AC voltage source 95. The effect of the DC electrical field is to enhance the attraction of developer material to sleeve 86, it is believed that the effect of the AC electrical field applied along the transport roller in loading zone 90 is to loosen the toner particles from their adhesive and triboelectric bonds to the carrier particles.

Figure 1:
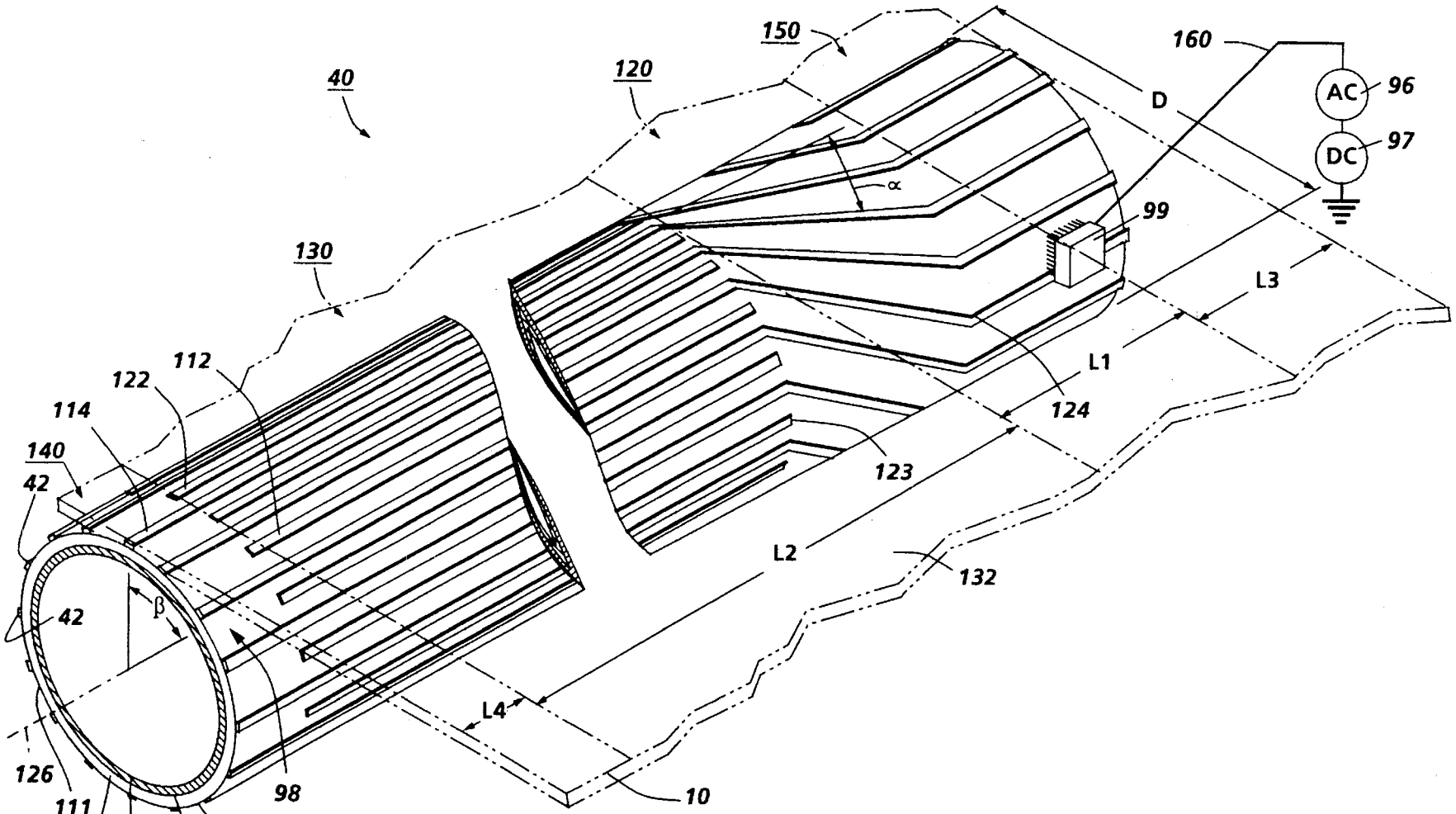
FIG. 1 is a fragmentary perspective view of the spiral segmented donor roll of the present invention.

While the development system 38 as shown in FIG. 1 utilizes donor roller DC voltage source 92 and AC voltage source 93 as well as transport roller DC voltage source 94 and AC voltage source 95, the invention may be practiced, with merely DC voltage source 92 on the donor roller.

It has been found that a value of up to 200 $V_{rms}$ is sufficient for the output of transport roll AC voltage source 95 for the desired level of reload efficiency of toner particles to be achieved. The actual value can be adjusted empirically. In theory, the value can be any value to a maximum voltage of about 400 $V_{rms}$. The source should be at a frequency of about 2 kHz. If the frequency is too low, e.g. less than 200 Hz, banding will appear on the copies. If the frequency is too high, e.g. more than 15 kHz, the system would probably work but the electronics may become expensive because of capacitive loading losses.

The donor roll 40 includes the electrodes 42 in the form of electrical conductors positioned about the peripheral circumferential surface thereof. The electrodes are preferably positioned above the circumferential surface and may be applied by any suitable process such as plating, overcoating or silk screening. It should be appreciated that the electrodes may alternatively be located in grooves (not shown) formed in the periphery of the roll 40. The electrical conductors 42 are substantially spaced from one another and insulated from the body of donor roll 40 which may be electrically conductive. Donor roll 40 rotates in the direction of arrow 91. The relative voltages between donor roll 40 and magnetic roll 46 are selected to provide efficient loading of toner on donor roll 40 from the carrier granules adhering to magnetic roll 46. Furthermore, reloading of developer material on magnetic roll 46 is also enhanced. In the development zone, AC and DC electrode voltage sources 96 and 97, respectively, electrically bias electrical conductors 42 to a DC voltage having an AC voltage superimposed thereon.

Figure 4:
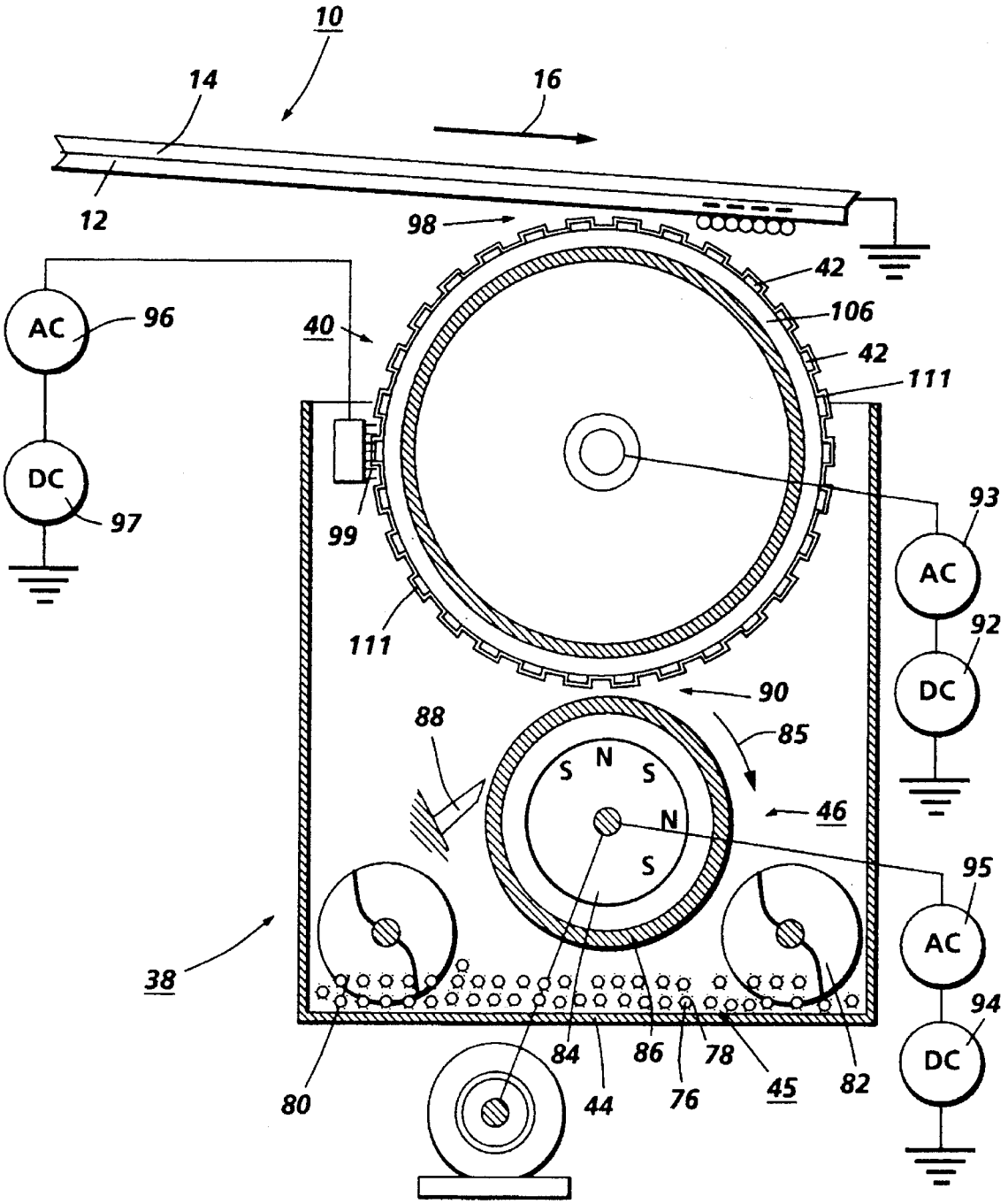
FIG. 4 is a schematic elevational view of an illustrative printing machine incorporating the spiral segmented donor roll of the present invention.

Electrode voltage sources 96 and 97 are in wiping contact with isolated electrodes 42. As donor roll 40 rotates in the direction of arrow 91, successive electrodes 42 advance into development zone 98, the nip between the donor roll 40 and the photoreceptor belt 10, and are electrically biased by voltage sources 96 and 97. As shown in FIG. 4, wiping brush 99 contacts isolated electrodes 42 in the development zone 98 and is electrically connected to electrode voltage sources 96 and 97. In this way, isolated electrodes or electrical conductors 42 advance into development zone 98 as donor roll 40 rotates in the direction of arrow 91. Isolated electrodes, i.e. electrical conductors 42, in development zone 98, contact wiping brush 99 and are electrically biased by electrode voltage sources 96 and 97. In this way, an AC voltage difference is applied between the isolated electrical conductors and the donor roll detaching toner from the donor roll and forming a toner powder cloud.

According to the present invention and referring to FIG. 1, donor roll 40 is shown. The photoconductive member in the form of the photoreceptor belt 10 is shown in phantom above the donor roll 40. The donor roll 40 is may be made of a core 102 such as in the form of a hollow tube. The core 102 may be made of any suitable durable material which may be conductive, semi-conductive or non-conductive. If the core 102 is made of a conductive core, the core is typically made of aluminum. It should be appreciated, however, that the core 102 may be made of a solid cylinder and be made of other conductive material such as steel, other metals, or a plastic material with carbon or other conductive additives.

Extending outwardly from periphery 104 of the core 102 is a dielectric layer 106. The dielectric layer 106 may be anodized aluminum or a polymer with an overcoating thickness from about 25 to 75 microns and is applied directly on the core 102 by spraying, dipping, powdered spraying, fluidized or any suitable technique. The dielectric coating may also be inorganic such as various oxide, flame spray coated and ceramics. Typical organic coatings include polyurethanes, polyesters, polytetra fluorethylenes, polycarbonates, and polyamides.

The electrode members 42 are located in an outer periphery 110 of the dielectric layer 106. The electrode members 42 are typically 50 to 150 microns wide and approximately 100 microns deep. The spacing between adjacent electrode member 42 is approximately 150 microns.

The electrode members are formed from an electrically conductive material on the dielectric layer 106. The electrically conductive material forms the electrical conductors or electrode members 42. The electrical conductors 42 have electrical conductivity of about $10^{-3}$ ohms-centimeters. A suitable electrically conductive material is a silver conductive epoxy or paint. The conductive material can be applied by an angular meniscus coater or by any other suitable method so that isolated conductors 42 are created.

A charge relaxable layer 111 is applied over the dielectric layer 106 at the electrode members 42 to prevent electrical shorting between the electrode members 42 at the brushes. The layer 111 has a thickness of about 5 microns, and has a conductivity chosen to allow dissipation of charge accumulation and permit penetration of fringe fields. The layer 111 can be spray or dip coated.

In the electrode pattern as shown in the donor roll 40 of FIG. 1, the electrode members 42 are of two types, biased electrodes 112 and common electrodes 114. AC and DC bias 96 and 97, respectively are applied to the biased electrodes 112. The common electrodes 114 are grounded. The biased electrodes 112 and common electrodes 114 are spaced approximately 0.15 millimeters apart. A powder cloud is formed in the development zone 98 or nip above the donor roll 40 between the charged biased electrode 112 and the common electrode 114. The charge moves from the biased electrode 112 through the dielectric layer 106 to the common electrode 114.

To provide for the application of the AC and DC bias 96 and 97, respectively, to the biased electrodes 112, the brush 99 is placed along the periphery 110 of the dielectric layer 110. Because the photoreceptor belt 110 is placed very close to the donor roll 40 at the nip 98 therebetween, it is impractical to place the brush 99 at the nip 98. The biased electrode 112 must be biased at the nip 98 in order that the powder cloud is located at the nip 98 between the donor roll 40 and the photoreceptor 10. To permit the biasing of the biased electrode 112 at the nip 98, the electrodes 42 include a first portion 120 in which the electrodes 42 extend around the outer periphery 110 of the dielectric layer 106 in a spiral fashion. The brush 99 conducts the AC and DC biases 96 and 97 to one of the biased electrodes, namely to nip biased electrode 122. An angle β defines the angle between the radial position of the nip biased electrode 122 at a first end 123 of the first portion 120 and the radial position of the nip bias electrode 122 at a second end 124 of the first portion 120. To permit ample room for the brush 99, the value of angle β is preferably approximately 90 degrees. It should be appreciated, however, that an angle β of 10 degrees or more may be sufficient to accomplish the purpose of the invention. It should also be noted that while the geometry of the electrodes in the first portion 120 as shown in FIG. 1 is a generally helical or spiral shape, any shape in which the electrodes 42 may extend around the periphery in a partially axially and partially tangential direction in which the adjacent electrodes 42 do not contact or intersect will accomplish the purpose of the invention.

For a spiral pattern of the electrodes 42 in the first portion 120, an angle α defines the angle between the electrodes 42 in the first portion 120 and a longitudinal axis 126 of the donor roll 40. Preferably, α is approximately equal to 45 degrees. It should be appreciated that larger and smaller angles of α may work suitably as well requiring correspondingly increased or decreased length to accomplish the proper angle β. For a donor roll 40 with a diameter D of approximately 25 millimeters, to accomplish an angle β of approximately 90 degrees, with an angle α of approximately 45 degrees, the first portion 120 must have a length L1 of approximately 20 millimeters.

The electrodes 42 in the periphery 110 of the donor roll 40 also describe a second portion 130 of the donor roll 40. In the second portion 130, the common electrodes 114 and the biased electrodes 112 are parallel and spaced from each other and are also parallel to the longitudinal axis 126 of the donor roll. The second portion 130 defines active or developing zone 132 of the photoreceptive belt 10. It is within the developing zone 132 that the developed image must occur.

The second portion 130 or the donor roll 40 has a length L2 of approximately 270 millimeters which permits a developing width of approximately 11 inches.

The electrodes 42 and the periphery 110 of the donor roll 40 further define a third portion 140 of the donor roll 40. The third portion 140 extends from the second portion 120. The first portion 120 is positioned between second portion 130 and the third portion 140. The third portion 140 serves to provide a location on the donor roll 40 where the brush 99 may contact the donor roll 40. The third portion 140 has a length L3 which is approximately 6 millimeters. The length of 6 millimeters is not critical but is sufficient to provide ample width for the brush 99. Preferably, the brush 99 is small enough such that the brush contacts only one biased electrode 112. The brush 99 may be made of any suitable durable material but is preferably made of a synthetic material impregnated with carbon to provide conductivity. While common electrodes 114 and biased electrodes 112 are located in the second portion 130, it should be appreciated that in the first portion 120 and the third portion 140, only the biased electrodes 112 are located. The brush 99 may alternatively be located in the first portion 120, eliminating the necessity of the third portion 140.

The electrodes 42 of the donor roll 40 further define a fourth portion 150 which extends from the second portion 130 opposite the first portion 120. In the fourth portion 150, only the common electrodes 114 are located. The common electrodes 114 extend parallel to longitudinal axis 124 outwardly from the second portion 130. The fourth portion 150 has a length L4 of approximately 9 millimeters which is sufficient for the grounding of the common electrodes along the periphery 110 of the dielectric layer 106 in the fourth portion 150.

The AC and DC biases 96 and 97 are electrically connected to brush 99 via an electrical conduit 160. The brush 99 contacts the third portion 140 of the donor roll at the nip electrode 122. The nip electrode extends in a direction parallel to longitudinal axis 126 through the third portion 140 to the first portion 120. In the first portion 120, the nip electrode 122 moves spirally about the periphery 110 of the donor roll to a position angle β out of phase with the position of the nip electrode 122 in the third portion 140. The nip electrode 122 in the second portion 130 extends in a direction parallel to longitudinal axis 126 and is located in the nip 98 between the donor roll and the photoreceptor 10. The nip electrode 122 ends at the second portion 130 adjacent the fourth portion 150. The bias from the biased electrode 122 passes along the dielectric layer 106 charging the toner 78 to form a powder cloud in the nip 98.

Figure 2:
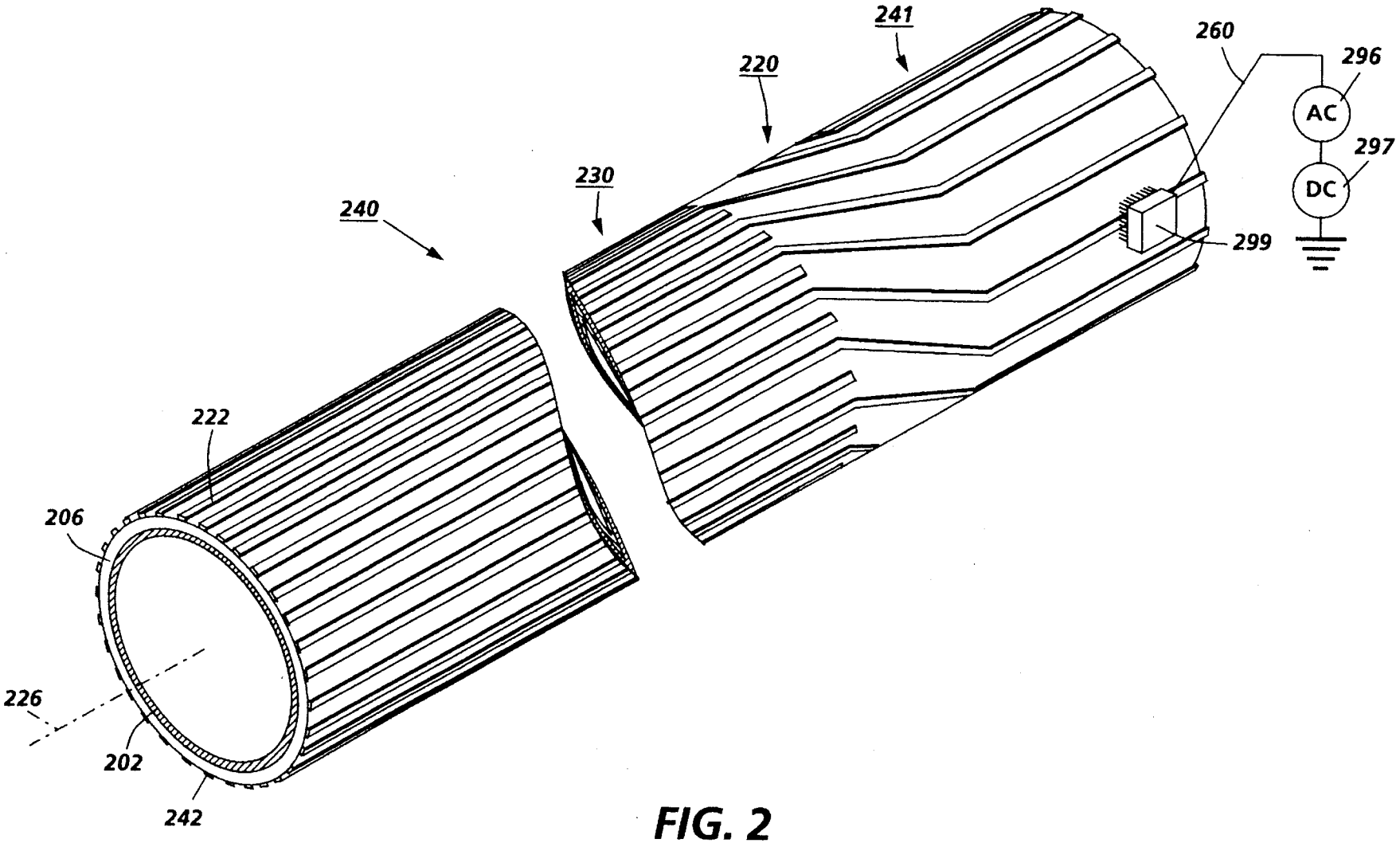
FIG. 2 is a fragmentary perspective view of an alternate embodiment of the spiral segmented donor roll of the present invention.

An alternate form of an electrode donor roll according to the present invention is shown in donor roll 240 of FIG. 2. Donor roll 240 is similar to donor roll 40 of FIG. 1, except that rather than having the common electrodes 114 of the donor roll 40, the donor roll 240 utilizes conductive core 202 to provide ground for the donor roll 240. The donor roll 240 includes peripheral electrodes 242 located on dielectric layer 206 of the donor roll 240. The electrodes 242 are similar in shape to the electrodes 42 of of the donor roll 40. The AC and DC electrode biases 296 and 297 pass from the electrodes 242 through the dielectric layer 206 to the conductive core 202. The powder cloud is formed when the electrode 242 passes through the dielectric layer 206 between the electrode 242 and the conductive core 202 charging the toner to form the toner cloud. The electrodes 242 define a first portion 220 of the donor roll 240. The first portion 220 includes the spiral electrodes 242. The donor roll 240 also includes a second portion 230 in which the electrodes 242 run parallel to longitudinal axis 226 of the donor roll 240. The second portion 230 is similar to the second portion 130 of the donor roll 40. The charging and developing occur in the second portion 230. The donor roll 240 also includes a third portion 241 which is similar to the third portion 140 of the donor roll 40. The third portion 241 serves to provide an area for brush 299 to contact the donor roll 240. The first portion 220 is located between the second portion 230 and the third portion 241.

AC and DC electrode biases 296 and 297 pass along electrical conductor 260 to the brush 299 which contacts nip biased electrode 222 in the third portion 241 of the donor roll 240. The charge passes along the nip biased electrode 222 from the third portion 241 through the first portion 220 to the second portion 230. The nip biased electrode 222 in the second portion 230 of the donor roll 240 excites the toner to form the toner cloud.

Figure 5:
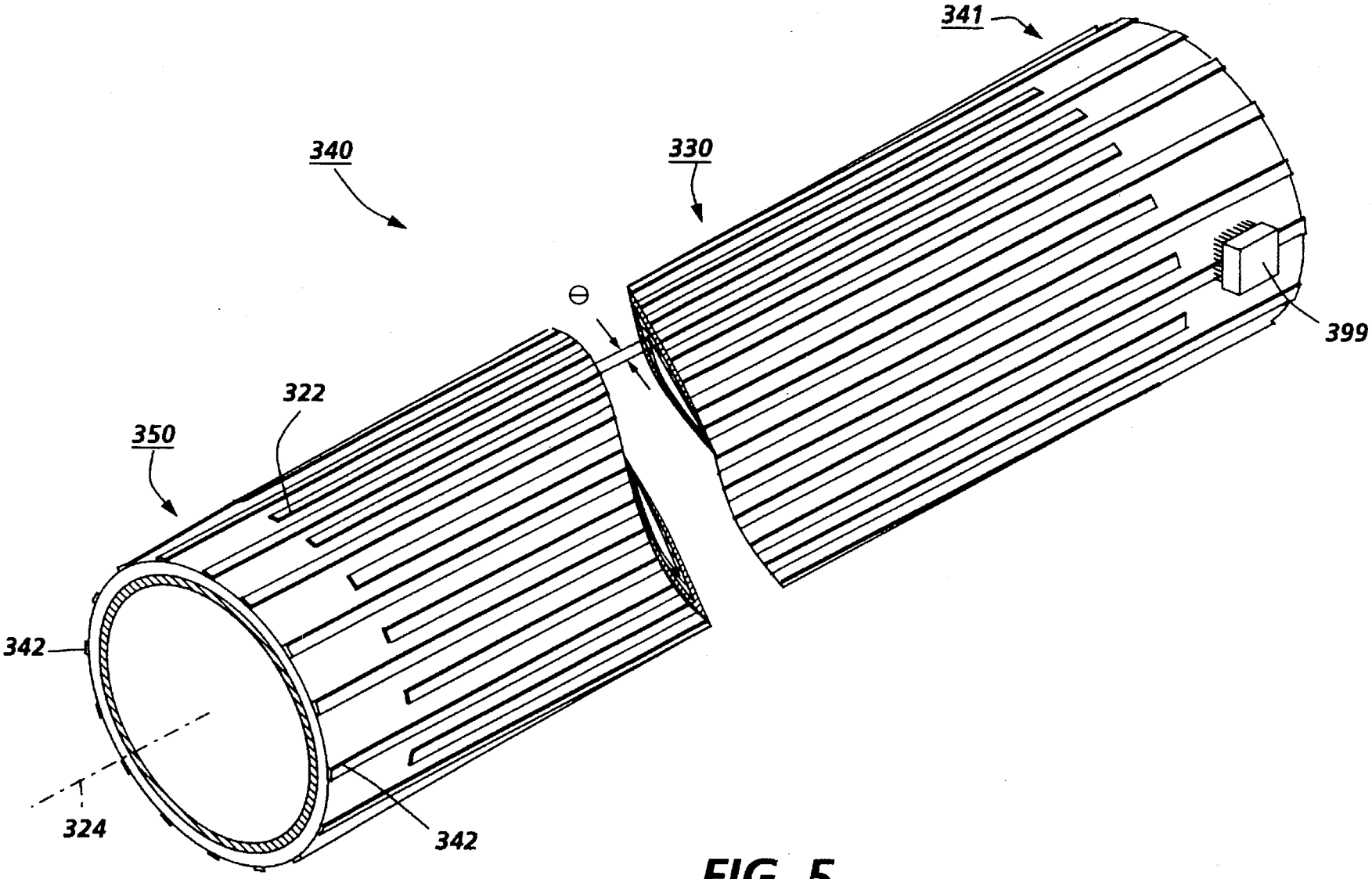
FIG. 5 is a fragmentary perspective view of another alternate embodiment of the spiral segmented donor roll of the present invention.

Another alternate embodiment of a donor roll according to the present invention is shown in donor roll 340 of FIG. 5. Electrodes 342 are formed on the periphery of the donor roll 340. The electrodes 342 are similar in shape to the electrodes 42 of the donor roll 40. Unlike the electrodes 42 of the second, third and fourth portion of the donor roll 40 of FIG. 1, the electrodes 342 are spirally located along the periphery of the donor roll 340 at an angle θ to the longitudinal axis 324 of the donor roll 340. The angle θ is approximately 3 degrees. The donor roll 340 includes a first portion 330 which is similar to the second portion 130 of the donor roll 40 and represents the area at which developing occurs. The donor roll 340 also includes a second portion 341 which is similar to the third portion 140 of the donor roll 40 and represents the portion where brush 399 contacts the donor roll 340. The donor roll 340 further includes a third portion 350 which is similar to the fourth portion 150 of the donor roll 40 and represents the area at which the common electrodes are grounded. The angle α of the donor roll 340 must be small in order that nip electrode 322 which is in contact with nip 98 (see FIG. 4) must be close to the nip 98. Since the angle θ must be small, the brush 399 must be small and be located somewhat near the nip 98 between the photoreceptor 10 and the donor roll 40.

The use of an electrode with a helical portion provides for commutating the biased electrodes in an area outside the nip without extending the overall length of the donor roll.

The use of a spiral electrode permits the commutating of the bias electrode inside the photoreceptor providing for a shorter, less expensive, more rigid and more accurate donor roll.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. A donor roll for transporting marking particles to an electrostatic latent Image recorded on a surface, comprising:

a body rotatable about a longitudinal axis; and an electrode member including a plurality of electrical conductors mounted on said body with adjacent electrical conductors being spaced from one another having at least a portion thereof extending in a direction transverse to the longitudinal axis of said body and with at least one of said conductors being electrically isolated from at least one of the remainder of said conductors.

2. A donor roll according to claim 1, wherein said body comprises a plurality of grooves on the periphery thereof with adjacent grooves being spaced from one another, a portion of said grooves being skewed to the longitudinal axis of said body.

3. A donor roll according to claim 2, wherein at least one of said electrical conductors is located in one of said grooves.

4. A donor roll according to claim 3, further comprising a dielectric layer disposed in at least one of the grooves of said roll interposed between said body and said electrical conductors, said dielectric layer being disposed about the circumferential surface of said body between adjacent grooves.

5. A donor roll according to claim 4, further comprising a charge relaxable layer contacting said electrical conductors and said dielectric layer disposed about the circumferential surface of said roll between adjacent grooves.

6. A donor roll according to claim 1, wherein said body includes a circumferential surface with said first mentioned portion of said plurality of conductors being spirally wound about a portion of the circumferential surface of said body.

7. A donor roll according to claim 6, wherein said first mentioned plurality of conductors intersect the longitudinal axis of said body at an angle of at least 3 degrees.

8. A donor roll for transporting marking particles to an electrostatic latent image recorded on a surface, comprising:

a body rotatable about a longitudinal axis; and an electrode member including a plurality of electrical conductors mounted on said body with adjacent electrical conductors being spaced from one another having at least a portion thereof extending in a direction transverse to the longitudinal axis of said body wherein said plurality of conductors includes a second portion extending in a direction substantially parallel to the longitudinal axis of said body.

9. A donor roll according to claim 8, wherein said plurality of conductors further comprise a third portion extending in a direction substantially parallel to the longitudinal axis of said body, said first mentioned portion being interposed between said second portion and said third portion.

10. A developer unit for developing a latent image recorded on an image receiving member to form a developed image, comprising:

a housing defining a chamber for storing at least a supply of toner therein; and a moving donor member spaced from the surface and adapted to transport toner from the chamber of said housing to a development zone adjacent the surface, said donor member including a body rotatable about a longitudinal axis and an electrode member including a plurality of electrical conductors mounted on said body with adjacent electrical conductors being spaced from one another having at least a portion thereof extending in a direction transverse to the longitudinal axis of said body and with at least one of said conductors being electrically isolated from at least one of the remainder of said conductors.

11. A developer unit according to claim 10, wherein said body comprises a plurality of grooves on the periphery thereof with adjacent grooves being spaced from one another, a portion of said grooves being skewed to the longitudinal axis of said body.

12. A developer unit according to claim 11, wherein at least one of said electrical conductors is located in one of said grooves.

13. A developer unit according to claim 12, further comprising a dielectric layer disposed in at least one of the grooves of said roll interposed between said body and said electrical conductors, said dielectric layer being disposed about the circumferential surface of said body between adjacent grooves.

14. A developer unit according to claim 13, further comprising a charge relaxable layer contacting said electrical conductors and said dielectric layer disposed about the circumferential surface of said roll between adjacent grooves.

15. A developer unit according to claim 10, wherein said body includes a circumferential surface with said first mentioned portion of said plurality of conductors being spirally wound about a portion of the circumferential surface of said body.

16. A developer unit according to claim 15, wherein said first mentioned plurality of conductors intersect the longitudinal axis of said body at an angle of at least 3 degrees.

17. A developer unit according to claim 10, further comprising means for electrically biasing said electrode member to detach toner from said donor member to form a cloud of toner in the space between said donor member and the surface with toner developing the image.

18. A developer unit according to claim 17, wherein said biasing means comprises:

a voltage source; and a brush, coupled to said voltage source, in contact with at least one of said plurality of electrical conductors.

19. A developer unit for developing a latent image recorded on an image receiving member to form a developed image, comprising:

a housing defining a chamber for storing at least a supply of toner therein; and a moving donor member spaced from the surface and adapted to transport toner from the chamber of said housing to a development zone adjacent the surface, said donor member including a body rotatable about a longitudinal axis and an electrode member including a plurality of electrical conductors mounted on said body with adjacent electrical conductors being spaced from one another having at least a portion thereof extending in a direction transverse to the longitudinal axis of said body, wherein said plurality of conductors include a second portion extending in a direction substantially parallel to the longitudinal axis of said body.

20. A developer unit according to claim 19, wherein said plurality of conductors further comprise a third portion extending in a direction substantially parallel to the longitudinal axis of said body, said first mentioned portion being interposed between said second portion and said third portion.

21. An electrophotographic printing machine of the type having a developer unit adapted to develop with marking particles an electrostatic latent image recorded on a photoconductive member, the machine comprising:

a housing defining a chamber for storing at least a supply of toner therein; and a moving donor member spaced from the surface and adapted to transport toner from the chamber of said housing to a development zone adjacent the surface, said donor member Including a body rotatable about a longitudinal axis and an electrode member Including a plurality of electrical conductors mounted on said body with adjacent electrical conductors being spaced from one another having at least a portion thereof extending in a direction transverse to the longitudinal axis of said body and with at least one of said conductors being electrically isolated from at least one of the remainder of said conductors.

22. A printing machine according to claim 21, wherein said body comprises a plurality of grooves on the periphery thereof with adjacent grooves being spaced from one another, a portion of said grooves being skewed to the longitudinal axis of said body.

23. A printing machine according to claim 22, wherein at least one of said electrical conductors is located in one of said grooves.

24. A printing machine according to claim 23, further comprising a dielectric layer disposed in at least one of the grooves of said roll interposed between said body and said electrical conductors, said dielectric layer being disposed about the circumferential surface of said body between adjacent grooves.

25. A printing machine according to claim 24, further comprising a charge relaxable layer contacting said electrical conductors and said dielectric layer disposed about the circumferential surface of said roll between adjacent grooves.

26. A printing machine according to claim 21, wherein said body includes a circumferential surface with said first mentioned portion of said plurality of conductors being spirally wound about a portion of the circumferential surface of said body.

27. A printing machine according to claim 26, wherein said first mentioned plurality of conductors intersect the longitudinal axis of said body at an angle of at least 3 degrees.

28. A printing machine according to claim 21, further comprising means for electrically biasing said electrode member to detach toner from said donor member to form a cloud of toner in the space between said donor member and the surface with toner developing the image.

29. A printing machine according to claim 28, wherein said biasing means comprises:

a voltage source; and a brush, coupled to said voltage source, in contact with at least one of said plurality of electrical conductors.

30. An electrophotographic printing machine of the type having a developer unit adapted to develop with marking particles an electrostatic latent image recorded on a photoconductive member, the machine comprising:

a housing defining a chamber for storing at least a supply of toner therein; and a moving donor member spaced from the surface and adapted to transport toner from the chamber of said housing to a development zone adjacent the surface, said donor member including a body rotatable about a longitudinal axis and an electrode member including a plurality of electrical conductors mounted on said body with adjacent electrical conductors being spaced from one another having at least a portion thereof extending in a direction transverse to the longitudinal axis of said body, wherein said plurality of conductors includes a second portion extending in a direction substantially parallel to the longitudinal axis of said body.

31. A printing machine according to claim 30, wherein said plurality of conductors further comprise a third portion extending in a direction substantially parallel to the longitudinal axis of said body, said first mentioned portion being interposed between said second portion and said third portion.

* * * * *